US006411320B1

(12) United States Patent
Mcdaniel et al.

(10) Patent No.: US 6,411,320 B1
(45) Date of Patent: Jun. 25, 2002

(54) SEGMENTED HEATED DRUM PROCESSOR

(75) Inventors: David J. Mcdaniel, Vdnais Heights; John T. Olson, Minneapolis, both of MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/918,888

(22) Filed: Jul. 31, 2001

(51) Int. Cl.[7] ..... B41J 2/435; G03G 15/20

(52) U.S. Cl. ..... 347/212; 347/156; 347/140; 347/228; 219/216; 430/330; 430/336

(58) Field of Search ..... 430/203, 269, 430/330, 336; 347/156, 140, 212, 228; 399/119, 222, 227, 320, 328, 330, 335, 338; 219/200, 216

(56) References Cited

U.S. PATENT DOCUMENTS 5,580,478 A 12/1996 Tanamachi et al.
5,990,461 A * 11/1999 Stumpf et al. ..... 219/216
6,007,971 A * 12/1999 Star et al. ..... 219/216
6,288,370 B1 * 9/2001 Ogawa et al. ..... 219/216
6,297,476 B1 * 10/2001 Kashino et al. ..... 219/216

* cited by examiner

*Primary Examiner*—Huan Tran
(74) *Attorney, Agent, or Firm*—William F. Noval

(57) ABSTRACT

A thermographic imaging system in which exposed thermographic imaging media is moved along a path, apparatus comprising: a movable member of thermally conductive material located along said path, said member having a first dimension parallel to said path and a second dimension perpendicular to said path, said member having a first side which thermally contacts media moved along said path and a second opposite side, a first electrical heater in thermal contact with said second side of said member; a second electrical heater in thermal contact with said second side of said member, said second electrical heater having a plurality of separately activated segments extending in said first dimension, and a control for selectively activating said segments as media is moved along said path into contiguity with each said segments.

10 Claims, 4 Drawing Sheets

SEGMENTED HEATED DRUM PROCESSOR

FIELD OF THE INVENTION

This invention relates in general to thermographic imaging systems and more particularly to improved processing temperature uniformity in heated drum processors for thermally processed thermographic imaging media.

BACKGROUND OF THE INVENTION

Photothermography is an established imaging technology. In photothermography, a photosensitive media is exposed to radiation to create a latent image which can then be thermally processed to develop the latent image. Devices and methods for implementing this thermal development process are generally known and include contacting the imaged photosensitive media with a heated platen, drum or belt, blowing heated air onto the media, immersing the media in a heated inert liquid and exposing the media to radiant energy of a wavelength to which the media is not photosensitive, e.g., infrared. Of these conventional techniques, the use of heated drums is particularly common.

A common photosensitive media useable in these imaging processes is known as a photothermographic media, such as film and paper. One photothermographic media has a binder, silver halide, organic salt of silver (or other deducible, light-insensitive silver source), and a reducing agent for the silver ion. In the trade, these photothermographic media are known as dry silver media, including dry silver film.

In order to precisely heat exposed photothermographic media, including film and paper, it has been found to be desirable to use electrically heated drums. An apparatus employing this technique, a cylindrical drum is heated to a temperature near the desired development temperature of the photothermographic media. The photothermographic media is held in close proximity to the heated drum as the drum is rotated about its longitudinal axis. When the temperature of the surface of the heated drum is known, the portion of the circumference around which the photothermographic media is held in close proximity is known and the rate of rotation of the drum is known, the development time and temperature of the thermographic media can be determined. Generally, these parameters are optimized for the particular photothermographic media utilized and, possibly, for the application in which the photothermographic media is employed.

U.S. Pat. 5,580,478, issued Dec. 3, 1996, inventors Tanamachi et al., discloses a temperature controlled, electrically heated drum for developing exposed photothermographic media. A cylindrical drum has a surface and is rotatable on an axis. An electrical heater is thermally coupled to the surface of the cylindrical drum.

Separate electrical resistance heaters heat a central heat zone and contiguous edge zones.

The present medical imaging film used can draw relatively significant amounts of heat from the processor drum surface as it first contacts the drum and warms up. Current drum processors typically use a circumambient (circumferentially uniform) internal drum heater. Normal heating devices include resistive element blanket heaters attached to the drum or lamp type radiative devices located in the drum core. Circumambient heaters can cause locations of the drum to under heat and over heat when film enters the processor. In locations of early film contact, where the most significant heat load takes place, the drum temperature can decrease while in other locations the drum temperature can increase because it is not loaded as much. The temperature controller does not correct this. In a closed loop temperature control setup, the drum temperature can be controlled to a tight temperature variation at a location on the drum, but the overall drum temperature will still vary because of the non-even heat load as the film is applied to the drum. There is thus a need for an improved heated drum for processing media which has improved processing temperature and uniformity.

SUMMARY OF THE INVENTION

According to the present invention, there is provided a solution to the problems and a fulfillment of the needs discussed above.

According to a feature of the present invention, there is provided in a thermographic imaging system in which exposed thermographic imaging media is moved along a path, apparatus comprising; a movable member of thermally conductive material located along said path, said member having a first dimension parallel to said path and a second dimension perpendicular to said path, said member having a first side which thermally contacts media moved along said path and a second opposite side, a first electrical heater in thermal contact with said second side of said member; a second electrical heater in thermal contact with said second side of said member, said second electrical heater having a plurality of separately activated segments extending in said first dimension; and a control for selectively activating said segments as media is moved along said path into contiguity with each said segments.

ADVANTAGEOUS EFFECT OF THE INVENTION

The invention has the following advantages.

1. Improved processing temperature uniformity in thermographic imaging systems.

2. Improved media uniformity.

DETAILED DESCRIPTION OF THE INVENTION

In general, according to the present invention, there is provided an improved heated drum for thermally processing exposed thermographic imaging media. Improved processing temperature uniformity has resulted in improved media uniformity. The heated drum includes a first electrical heater which extends around the drum's internal circumference and which is activated substantially continuously. A second electrical heater extends around the drum's internal circumference but is circumferentially segmented so that segments are activated as media comes into contact with the drum.

Figure 1:
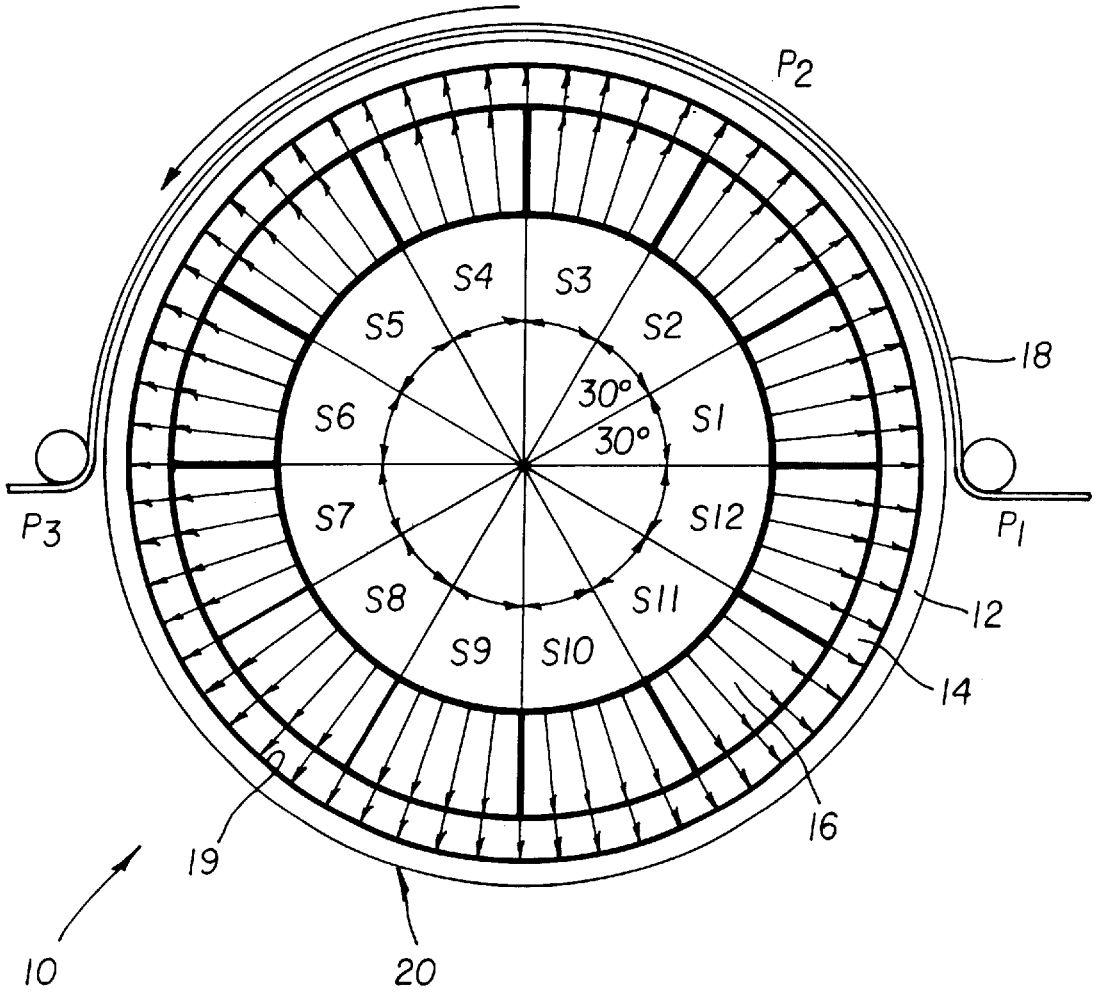
FIG. 1 is a diagrammatic view of an embodiment of the present invention.

Referring now to FIG. 1, heater drum 10 includes a cylindrical drum 12 of thermally conductive material such as aluminum. A first electrical heater 14 (layer 1) and second electrical heater 16 (layer 2) are in thermal contact with the inner surface 19 of drum 12. Second, electrical heater 16 includes twelve circumferentially positioned segments $S_1, \ldots, S_{12}$, which are individually activated as media 18 comes into contact with the outer surface 20 of drum 10. Drum 10 has a first or circumference dimension parallel to the path of movement of a media 18 in contact with drum 10 and a second or width dimension perpendicular to the first dimension.

Figure 5:
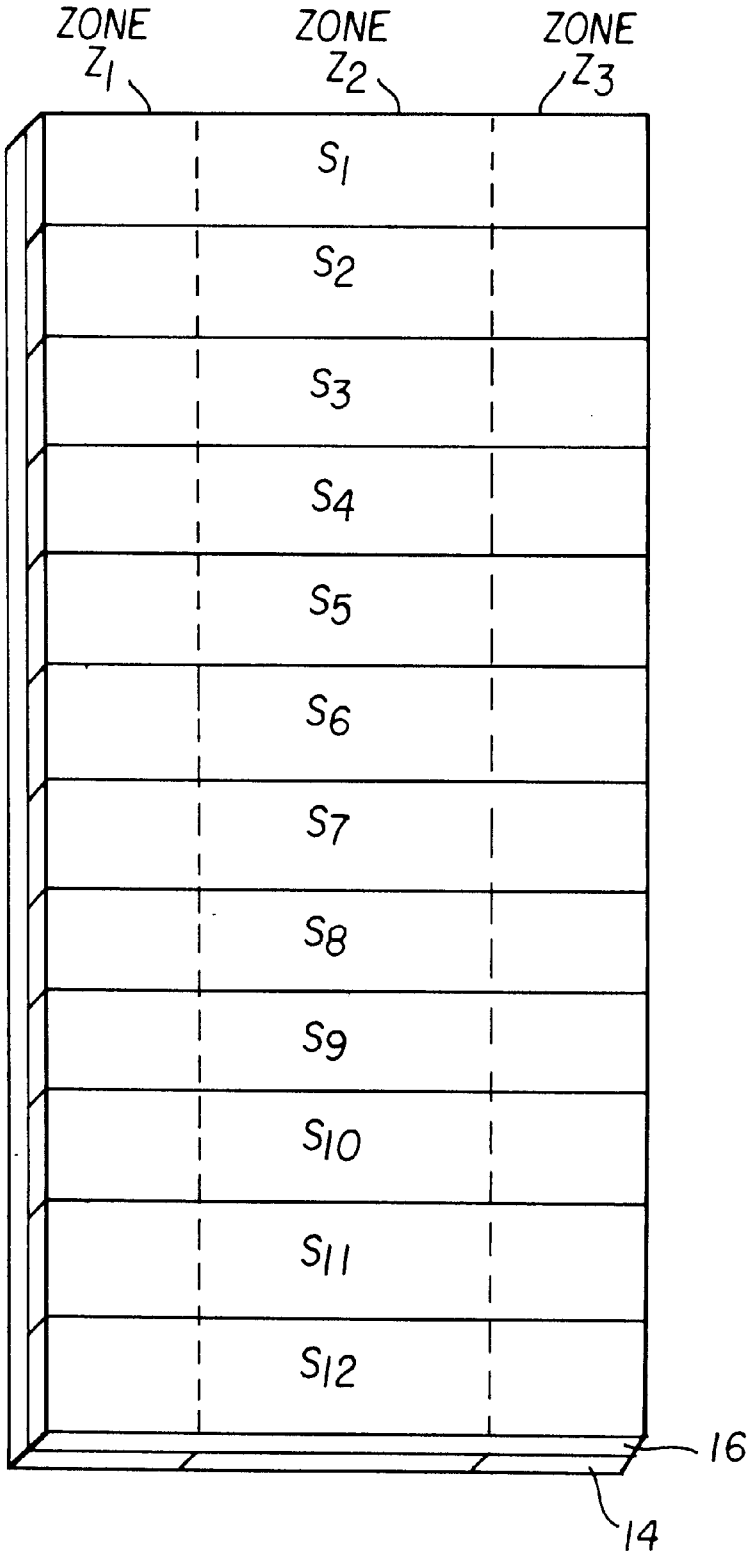
FIG. 5 is a diagrammatic view of another embodiment of the present invention.

These two layers 14 and 16 can sometimes be manufactured into one layer depending on heater wire sizes and routing restrictions, but can still act independently. The drum 10 operates typically under two different states: idle and load. The idle state is the case where there is no film 18 contacting drum 10, and the load state is the case where film 18 is contacting the drum 10. The idle layer (layer 1) 14 represents the current technology where, for example three heater zones coexist with three RTD sensors connected to independent temperature controllers as shown in FIG. 5, heaters 14, 16 are depicted in a stretched out state before formation into cylinders affixed to the inner surface 19 of drum 12. The three zones are for the left, center and right crossweb locations along the drum 10. Each zone ($Z_1$, $Z_2$, $Z_3$) in the idle layer 14 has a constant heat flux pattern along the downweb or circumferential direction. The load heater layer (layer 2) 16 provides the extra heat energy needed when the film 18 is being processed. This layer 16 is broken into load segments or zones around the drum's circumference. FIG. 1 shows the segments broken into 12 arcs ($S_1$, $S_2, \ldots, S_{12}$), each 30 degrees in angle. The segment number total depends on the drum's rotation speed, diameter and heat load and was optimized through trial and error in this case. As the film 18 enters the rotating drum 10, the first load segment ($S_1$) activates nearest to the film's lead edge. Next, the second load segment ($S_2$) activates when the film reaches it. This process continues until a specific number of segments is reached in arc length. In FIG. 1, two segments make up that number and activate between locations P1 and P2. When this length is reached, the first load segment ($S_1$) shuts off and the next load segment ($S_3$) is turned on. The process stops when the tail end of the film 18 enters the drum 10 and the load segment adjacent to this location is powered on and then off for a period of time that is consistent as part of the normal sequence which is then terminated. Each segment ideally provides enough extra heat energy to heat the film at that arc segment location. The number of heater load segments activated at a time must be calculated. Ideally, there would be a high number of segments present, but this is not practical from a cost standpoint. Numerical simulation has shown that 30 degree arc segments will work with an eight inch outer diameter drum rotating at two RPM with no more than two segments activated at a time when the medical imaging film is processing.

A time dependent, two dimensional finite element model was constructed. It simulated an eight inch round thermal processor heating an eight mil. thick, 17 inch long sheet of polyester base film in the downweb direction. The drum was made of aluminum and was 0.25 inches thick. It used a dual layer idle and load segmented heater attached to the inner aluminum surface of the drum. The load heater was segmented into 12 arcs like FIG. 1 shows. A discreet proportional controller was simulated to control the drum temperature. In the model, the controller responded by measuring the average temperature around the inner aluminum circumference of the drum. The proportional bandwidth and controller cycle time were optimized to reduce controller temperature variation. No temperature sensors were needed for the load heater layer because this layer is only activated by film presence. Film was applied to the drum using gap conduction elements in the locations of contact. The film's wrap angle about the drum was 180 degrees (between P1 and P3 in FIG. 1). The silicone surface of the drum and the film were subjected to air convection boundary conditions modeled after Newton's cooling law to simulate normal heat loss in their respective environments. The air convection boundary conditions were applied uniformly to the drum and film surface. In locations where the film was in contact with the drum, the convection on the film from that surface was removed. The ambient temperature of the film was lower than the drum.

Figure 2:
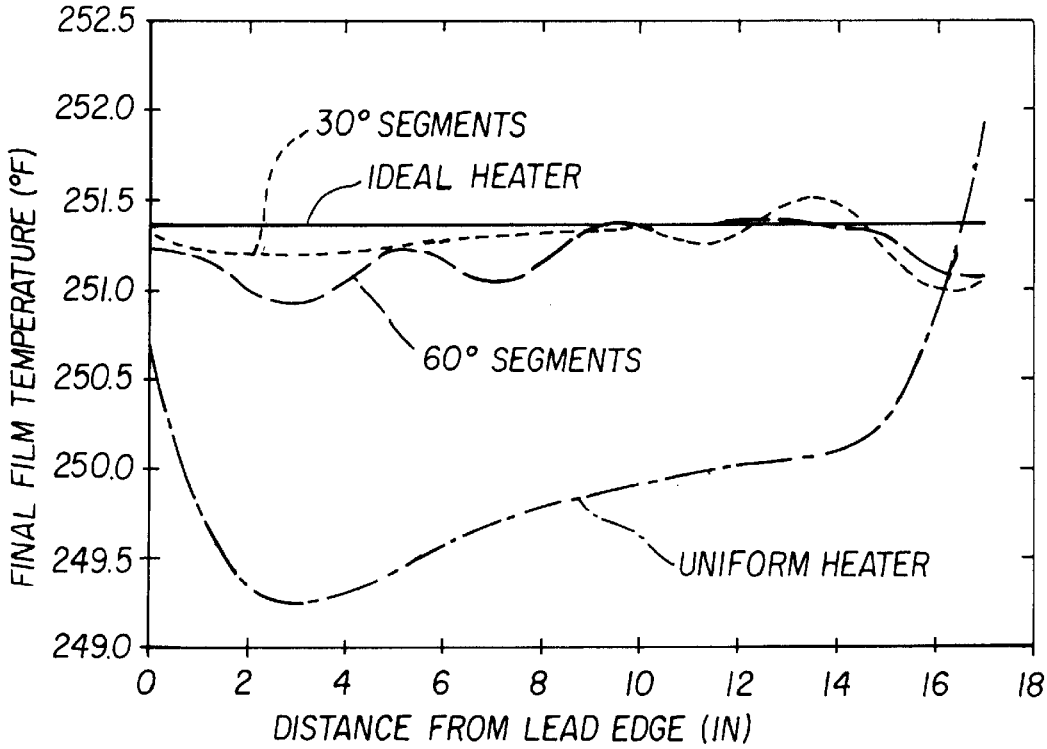
FIGS. 2 and 3 are graphical views useful in explaining the operation of the present invention.

Four heater configuration results are graphed from the numerical model in FIG. 2. In the graph, the horizontal axis represents the length of film processed from head to tail. The film was 17 inches long. The vertical axis represents the final temperature the film reached on the drum just as it detached from the drum surface (finished processing). This graph essentially shows how uniform a piece of film is processed on the drum. The flatter the line, the more uniform it is processed.

The first case is the Uniform Heater. This would be the style of drum 10 with a circumambient heat flux single layer blanket heater 14 attached to the inner surface of the drum 10. In this case, the film temperature begins to fall as the film 18 is processed after which the temperature then increases at a slow then faster rate. The initial temperature fall off is a response to the drum 10 being cooled by the film in a localized region and the temperature controller increasing its duty cycle to counteract. The entire inner surface of the drum 10 is heated. Because only a local region is cooling, the controller does not respond as strong as necessary. As the film 18 continues to load the drum 10, the controller continues to heat the drum 10. This heating effect catches up as new film 18 is applied and eventually the new film is warmed to a higher temperature than the previous section film 18 because the drum's temperature is increasing where new film 18 is being applied. The effect is very prominent for the tail section of film 18 because a significant section of the drum 10 has now been heated but no new film 18 is being applied and cooling the drum 10. The hottest section of the drum 10 heats the last section of film 18.

The second and third case results add a segmented load heater 16. One has 60 degree arc segments and the second has 30 degree arc segments. The segments as discussed previously switch on one-by-one as the film 18 is loaded onto the drum 10. Two segments are powered on for the 30 degree and one single segment for the 60 degree heater. Under these conditions, the amount of power produced by the load heater segments turned on is set to ideally equal the amount of power the film 18 draws from the drum 10. Heat flux values for the load heater segments are then derived from this requirement. Once the film's tail edge passes the midpoint of the last heater zone segment that contacts it, the load heater switching sequence terminates. The 30 degree segment version produce very uniform processed film. The 60 degree case appeared to produce a temperature oscillation pattern that was not as optimal but still better than the original uniform heater.

For the fourth case, as can be done with numerical models, an ideal heater was modeled where the inner drum temperature was fixed to the controller temperature set point. This simulated a heater with a continuously varying watt density profile that changed as the film loaded onto the drum. This result shows what potential a special heater which followed the heat load profile of the drum could do.

Another important feature of the segmented heater is that it reduces the duty cycle variation for the controller. With a uniform heater, the temperature controller monitors the two distinct load states of idle and load. The controller naturally increases its duty cycle when the load state occurs. The amount it increases is a function of how much more power is necessary and how much power is available. The load heater reduces the duty cycle change of the controller between states.

Figure 3:
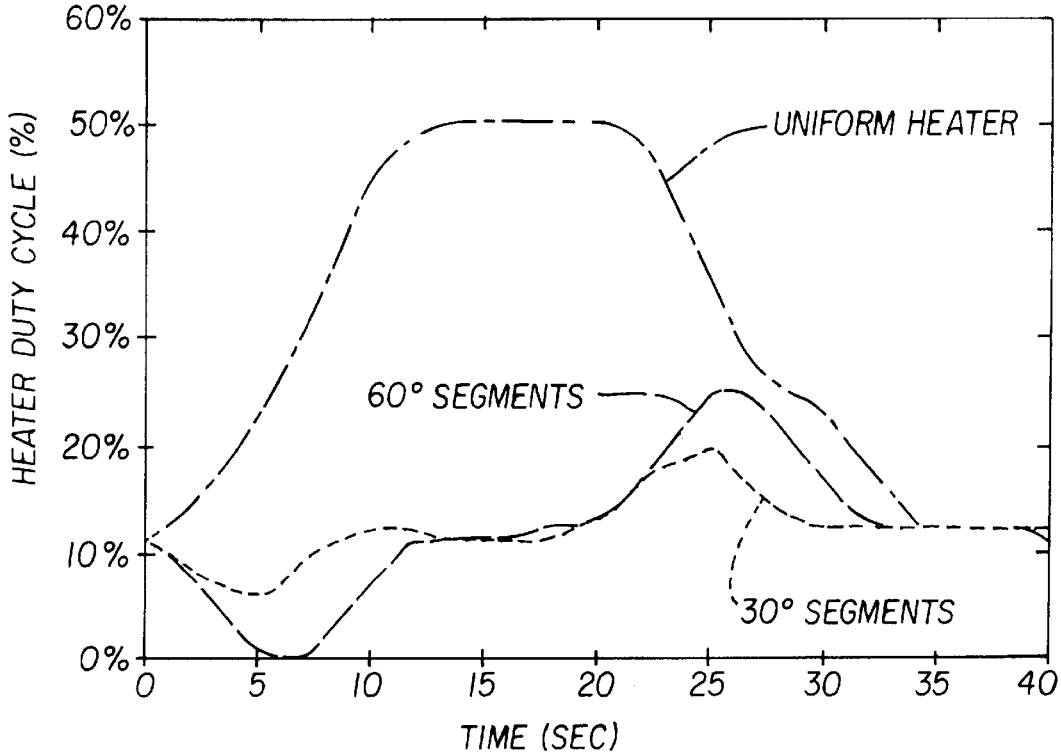

FIG. 3 shows the heater duty cycles for the first three case results presented. The film 18 contacts the drum 10 at time zero. The film 18 dwells on the drum 10 for 15 seconds. The wrap angle and the film length were previously shown. With a uniform heater, the duty cycle increases from approximately 11 percent to 50 percent. The segmented heater cases reduced the duty cycle variation significantly. During the load state's midway point in time, the duty cycle equaled the idle state value indicating that load heaters were matched to the film heat load. The 30 degree case was better than the 60 degree case.

To build a segmented drum heater several parts are required. A sensor is needed to detect drum position. Another sensor is needed to detect film presence. The load heater would connect to a power controller with logic switches activating each segment when necessary. The duty cycle of this power controller either would be turned to a specific value depending on film load or actively adjusted based upon some feedback signal device. One feedback signal device is the idle heater duty cycle control value. As the idle heater duty cycle increased, the load duty cycle could increase and vice-versa. The idle heater duty cycle ideally does not change when the load beaters segments are activated when film is present.

Figure 4:
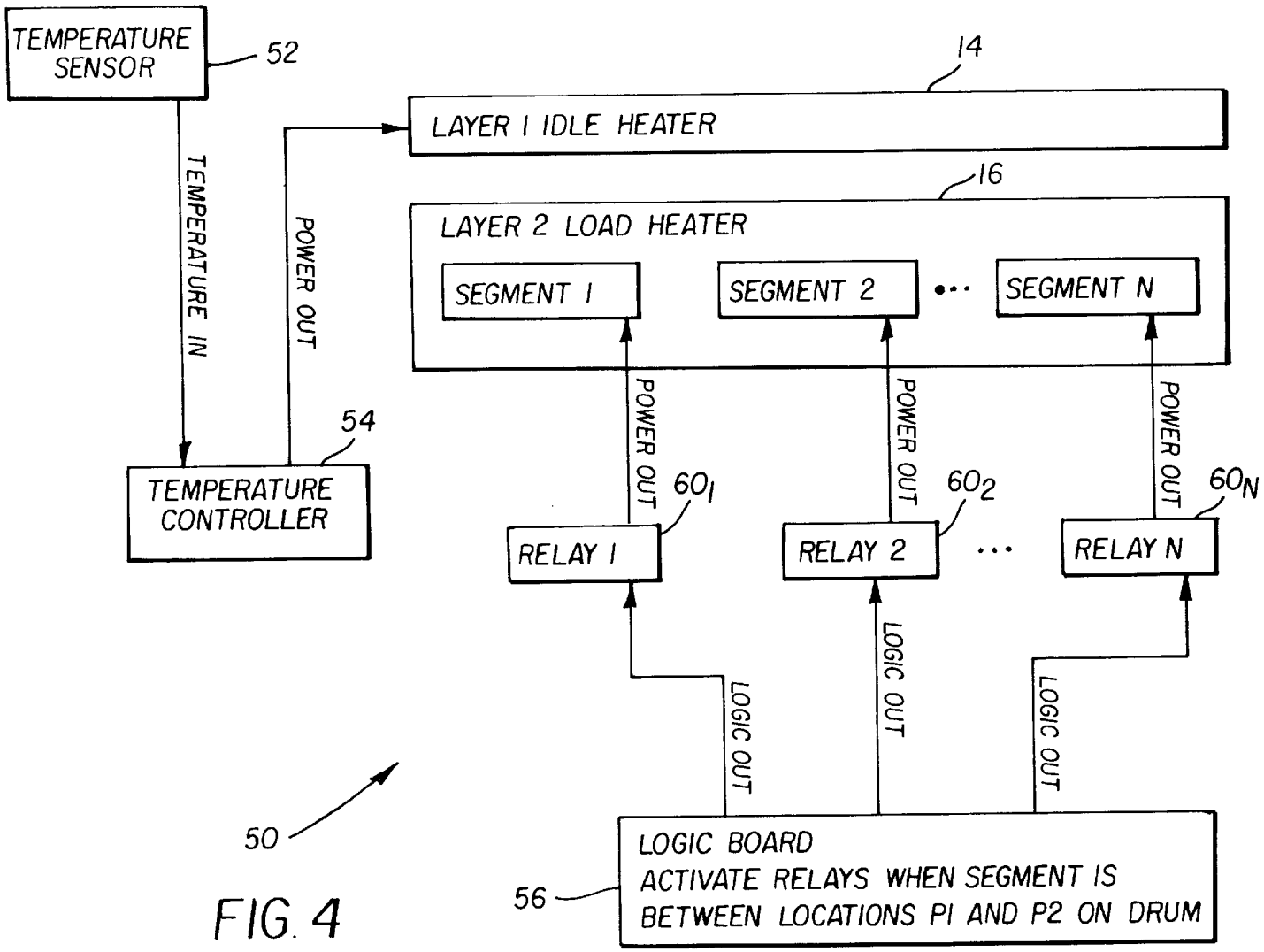
FIG. 4 is a block diagram of a control logic system for the present invention.

Referring now to FIG. 4, there is shown a block diagram of a controller for controlling the heating of heater drum 10. As shown, controller 50 includes temperature sensor 52, temperature controller 54, logic board 56 and relays $\mathbf{60}_1$, $\mathbf{60}_2$, . . . , $\mathbf{60}_N$ Temperature sensor 52 provides the temperature of drum 10 to temperature controller 54 which controls the temperature of first electrical heater 14. Logic board 56 activates relays $\mathbf{60}_1$, $\mathbf{60}_2$, . . . , $\mathbf{60}_N$ to provide electrical power to segments $_{1,\ 2}$, . . . $_N$ when a segment of second electrical heater 16 (layer 2) is between locations $P_1$, and $P_2$ on drum 10 (FIG. 1).

Although the invention has been described as including a heated drum, other continuous members can also be used such as a continuous thermally conductive belt which is heated by said first and second electrical heaters.

The invention has been described in detail with particular reference to certain preferred embodiments thereof, but it will be understood that variations and modifications can be effected within the spirit and scope of the invention.

10 drum
12 cylindrical drum
14 first electrical heater
16 second electrical heater
18 film
19 inner surface of drum 12
20 outer surface of drum 12
50 controller
52 temperature sensor
54 temperature controller
56 logic board
60 relays

What is claimed is:

1. A thermographic imaging system in which exposed thermographic imaging media is moved along a path, apparatus comprising:

a movable member of thermally conductive material located along said path, said member having a first dimension parallel to said path and a second dimension perpendicular to said path, said member having a first side which thermally contacts media moved along said path and a second opposite side, a first electrical heater in thermal contact with said second side of said member;

a second electrical heater in thermal contact with said second side of said member, said second electrical heater having a plurality of separately activated segments extending in said first dimension; and a control for selectively activating said segments of said second electrical heater as media is moved along said path into contiguity with each said segments.

2. The apparatus of claim 1 wherein said member includes a rotatable drum having a first dimension which is the circumference of the drum and a second dimension which is the width of said drum; and wherein said second electrical heater includes contiguous segments which extend around the circumference of said drum.

3. The apparatus of claim 1 wherein said control activates said segments of said second electrical heater in sequence and activates said first electrical heater substantially continuously to maintain substantially uniform heating of said member to produce uniformly processed media.

4. A thermographic imaging system is which exposed thermographic imaging media is moved along a path, apparatus comprising:

a rotatable drum of thermally conductive material located along said path, said drum having a first;

circumference dimension parallel to said path and a second, width dimension perpendicular to said path, said drum having a first, outer side which thermally contacts media moved along said path and a second inner side;

a first electrical heater in thermal contact with said second, inner side of said drum and extending the circumference and width of said drum;

a second electrical heater in thermal contact with said second, inner side of said drum and extending the circumference and width of said drum, said second electrical heater including contiguous segments which extend around the circumference of said drum; and a control for selectively activating said segments of said second electrical heater as media is moved along said path into contiguity with said segments.

5. The apparatus of claim 4 wherein said drum includes a cylindrical member of thermally conductive metal and an outer resilient layer of thermally conductive silicone.

6. The apparatus of claim 5 wherein said cylindrical member is made of aluminum.

7. The apparatus of claim 4 wherein said first electrical heater includes at least two segments extending the width of said drum.

8. The apparatus of claim 4 wherein said first electrical heater includes three segments extending the width of said drum.

9. The apparatus of claim 4 wherein said first and second electrical heaters constitute separate layers in thermal contact with said second side of said drum.

10. The apparatus of claim 4 wherein said first and second electrical heaters form a single composite layer in thermal contact with said second side of said drum.

* * * * *